US009402525B2

(12) United States Patent
Ellebracht

(10) Patent No.: US 9,402,525 B2
(45) Date of Patent: Aug. 2, 2016

(54) DISHWASHER-DINING TABLE HAVING ROTATABLE TABLETOP

(71) Applicant: Stephen Robert Ellebracht, Sedalia, MO (US)

(72) Inventor: Stephen Robert Ellebracht, Sedalia, MO (US)

(73) Assignee: Stephen R. Ellebracht, Sedalia, MO (US)

( * ) Notice: Subject to any disclaimer, the term of this patent is extended or adjusted under 35 U.S.C. 154(b) by 285 days.

(21) Appl. No.: 13/843,177

(22) Filed: Mar. 15, 2013

(65) Prior Publication Data

US 2014/0261552 A1 Sep. 18, 2014

(51) Int. Cl.

| | |
|---|---|
| ***A47L 15/42*** | (2006.01) |
| ***A47L 15/00*** | (2006.01) |
| ***A47B 13/08*** | (2006.01) |
| ***A47B 31/00*** | (2006.01) |
| ***A47L 15/22*** | (2006.01) |
| ***A47B 77/08*** | (2006.01) |

(52) U.S. Cl.

CPC ..... *A47L 15/0097* (2013.01); *A47B 13/08* (2013.01); *A47B 31/001* (2013.01); *A47B 77/08* (2013.01); *A47L 15/00* (2013.01); *A47L 15/22* (2013.01); *A47L 15/0086* (2013.01); *Y10T 29/49826* (2015.01)

(58) Field of Classification Search

CPC . A47L 15/00; A47L 15/0097; A47L 15/0086; A47L 15/50; A47L 15/501; A47L 15/502; A47L 15/505; A47B 31/001; A47B 77/08; A47B 13/08

USPC ..... 134/115 R

See application file for complete search history.

(56) References Cited

U.S. PATENT DOCUMENTS

| | | | | |
|---|---|---|---|---|
| 1,952,568 | A | 3/1934 | Schapp | |
| 2,750,611 | A | 4/1952 | Chatel | |
| 3,005,282 | A | 7/1958 | Christiansen | |
| 2,971,519 | A * | 2/1961 | Willson | A47L 15/0086 134/100.1 |
| 3,075,215 | A * | 1/1963 | Marue | 15/77 |
| 3,941,139 | A | 3/1976 | Spiegel | |
| 4,038,103 | A | 7/1977 | Grunewald | |
| 4,179,307 | A * | 12/1979 | Cau et al. | 134/58 D |
| 4,245,309 | A | 1/1981 | Kiefer | |
| 5,017,852 | A | 5/1991 | Kamino et al. | |
| 5,201,826 | A * | 4/1993 | Zimmermann | A47L 15/505 211/41.9 |

(Continued)

FOREIGN PATENT DOCUMENTS

| | | | | |
|---|---|---|---|---|
| CH | 483231 A | * | 12/1969 | A47B 31/001 |
| CN | 2484816 Y | * | 4/2002 | |

(Continued)

OTHER PUBLICATIONS

Machine translation of CN 101716031 A, dated Jun. 2010.*

(Continued)

*Primary Examiner* — Michael Barr
*Assistant Examiner* — Kevin G Lee
(74) *Attorney, Agent, or Firm* — Donald N. Payne, Jr.

(57) ABSTRACT

The invention is directed to a novel dishwasher-dining table combination appliance having a rotatable, invertible top dining insert panel that allows for cleaning dining utensils and the like without having to remove them from a table. The invention provides for a compact, self-contained, system useful in a variety of locations and applications where reductions in the length of time required for cleaning, storing and replacing dining utensils on a table are advantageous.

15 Claims, 8 Drawing Sheets

(56) References Cited

U.S. PATENT DOCUMENTS

| | | | | |
|---|---|---|---|---|
| 5,202,582 | A | 4/1993 | Borgerding et al. | |
| 5,205,304 | A * | 4/1993 | Cooper et al. | 134/99.2 |
| 5,448,115 | A | 9/1995 | Howland et al. | |
| 5,628,334 | A | 5/1997 | Dries et al. | |
| 5,687,752 | A * | 11/1997 | Boylan | A47L 15/42 134/115 R |
| 6,605,157 | B2 | 8/2003 | Hegeman | |
| 6,648,981 | B2 | 11/2003 | McIntyre et al. | |
| 7,379,778 | B2 | 5/2008 | Black et al. | |
| 7,686,890 | B2 | 3/2010 | King et al. | |
| 7,726,324 | B2 | 6/2010 | Ahn et al. | |
| 7,837,802 | B2 | 11/2010 | Kang | |
| 8,025,169 | B2 | 9/2011 | Zimmerman | |
| 8,800,984 | B2 * | 8/2014 | Constantino et al. | 269/302.1 |
| 2006/0237053 | A1 * | 10/2006 | Bengston | A47L 15/502 134/58 D |
| 2009/0243869 | A1 * | 10/2009 | Sanderford, Jr. | 340/657 |

FOREIGN PATENT DOCUMENTS

| | | | | |
|---|---|---|---|---|
| CN | 101716031 | A * | 6/2010 | |
| DE | 2938176 | A1 * | 4/1981 | A47B 35/00 |
| DE | 102008004101 | A1 * | 7/2009 | |
| ES | 2348898 | A1 * | 12/2010 | A47B 31/001 |

OTHER PUBLICATIONS

3docean.net, Pyramid Table and Chair, Jun. 10, 2012 (available at https://web.archive.org/web/20120610182521/http://3docean.net/item/pyramid-table-and-chair/2471736) (henceforth "3docean").*

W. Bolton, Mathematics for Engineering, 2nd Edition, Routledge 2000 at p. 17 in particular, "2.3.2 Frusta of prisms".*

Lifeinteriors.com, Pyramid Dining Table, Mar. 26, 2012 (available at https://web.archive.org/web/20120326085252/http://www.lifeinteriors.com.au/online-shop/dining-tables/pyramid-dining-table).*

The Complete Technology Book on Industrial Polymers, Additives, Colourants and Fillers, NIIR Board of Consultants & Engineers, Asia Pacific Business Press Inc., Jan 1, 2006.*

* cited by examiner

DISHWASHER-DINING TABLE HAVING ROTATABLE TABLETOP

CROSS-REFERENCE TO RELATED APPLICATIONS

There are no related applications.

FIELD OF THE INVENTION

The invention relates to a combined automatic dishwasher and dining table, the table portion having an rotatable, invertible top and utensil retaining devices for washing dining utensils without removing them from the table.

BACKGROUND

It has long been recognized that tools useful for preparing and consuming foodstuffs require a certain degree of cleanliness and/or sterility to limit or prevent disease conditions in humans. Accordingly, it is generally accepted that some effective cleaning process for cooking and eating utensils is virtually required to ensure and maintain a minimal level of sterility or cleanliness. In the industrial era, it has been well recognized that various cleaning agents (detergents and builders) and heated water, or other specialized cleaning solutions, are useful in achieving adequately clean cooking tools and dining utensils. Until the modern industrial era, kitchen and eating utensils were cleaned by generally slow, manual, operations. But, economic advancements, and societal preference changes, have caused demand changes for people to own effective dining and food preparation appliances, cleaning tools and the like. In particular, there has been increased desire to make the process of cleaning kitchen utensils more efficient. To satisfy this desire, numerous manufacturers have developed what has become an extremely common appliance to effectively clean kitchen utensils known as "automatic dishwasher". This appliance has significantly improved productivity by primarily eliminating manual washing tasks. But, this appliance still requires moving dishes, etc. from a dining location, arranging them in the washer (a sometimes daunting, time-consuming task) and subsequently moving the cleaned items to a relatively secure storage area to ensure continued cleanliness. Additionally, to prepare for dining, the dishes and other utensils must be moved from storage and arranged on the table. Simple time-motion studies regarding such cleaning steps underscores the realization that considerable time is thus taken cleaning a dining table, stacking dishes, arranging them in the dishwasher and often having to repeat the process for a given dining experience when there are more dishes and utensils than washer space. Accordingly, it would be useful to have processes and appliances that advance this art, including: improving time and efficiency in washing, drying, utensil storage and the like.

Secondarily to the general problem of effectively and efficiently providing clean, sterile dishes, cookware and utensils for individuals, is the time required to move, load and unload dishes to a large dishwasher and subsequently setup a dining table in high throughput dining operations where the atmosphere of dining is less of a priority. For example, cleaning and setup-steps are even more costly for businesses such as industrial cafeterias, schools, shift-work oriented businesses, the military, and the like. Decreases in the food consumption-utensil cleaning-setup cycles are extremely desirable is such environments and labor costs via time-savings are generally very desirable. Also desirable is reducing space consumption and overall improved ergonomic operation of various floor-space constrained kitchen-dining environments such as small apartments and homes, marine vehicles (e.g. sail and power water craft), meeting rooms, and the like. Additionally, many individuals in this day and time are much less concerned with owning multiple sets of dining utensils and far more concerned with being able to quickly eat and clean their used dishes.

Further, it is presently desirable in age of wide geographic coverage of computer and cellular phone networks (e.g. "WiFi") to control and access home appliances, such as a dishwasher, by remote control through wireless internet connections, cellular telephones and the like.

A number of past descriptions appear in the art of dining/dishwashing appliances. For example, U.S. Pat. No. 2,750,611 describes an "Automatic Meal Table": essentially this description is directed to an table+dishwasher appliance whereby a dining place setting is securely placed onto a movable endless belt which moves the dishes to be washed through a series of washing, rinsing, and drying step. Accompanied with this appliance are a complicated series of mechanical means to facilitate the cleaning, rinsing, and drying processes.

U.S. Pat. No. 2,971,519 describes a combined dining table and dishwasher, the principal object of which is to provide, in a single structure, a dining surface, and several compartments underneath to wash and store dishes, etc., below a table top, thereby eliminating the usual five or more operations of cleaning the table, washing the dishes and flatware, drying and storing them and setting the table for the next meal. As with U.S. Pat. No. 2,750,611, the U.S. Pat. No. 2,971,519 description includes extensive, complicated mechanical mechanisms for accomplishing the goals of the invention. But, this invention also fails to eliminate the process of setting a table subsequent to washing and also places dishes, glasses, flatware and the like in an awkward position underneath the top of a table where they may be susceptible to breakage on removal.

U.S. Pat. No. 1,952,568 to Schapp et al. proposes an early, simple method to provide clean eating utensils by integrating plates, bowels, drinking glasses and flatware into a single modular tray which can then be manually cleaned by reversing the tray onto a tabletop that incorporates washing means such as a modified sink.

U.S. Pat. No. 6,378,537 B1 to DeHart describes an integral dining table and dishwasher unit where a hinged access cover is supplied to access the dishwasher and a tray that moves upwardly and downwardly is supplied for automatic flush mounting at the table level: a perforated chute extending from below the dining surface into the dishwasher is used for placing and retrieving dishes and storing dishes during washing. A separate compartment, in another section of the table, is taught available for washing pots and other large utensils. Despite some of the aforementioned advances in the art directed to preparing eating utensils for cleaning and use, there are still opportunities for further labor reductions, time saving, compact appliances. Accordingly, it would be useful to provide new solutions to the art.

SUMMARY OF THE INVENTION

In a first aspect of the invention, there is provided a dishwasher-dining table housing having inside and outside surfaces, comprising a first vertical housing portion having a rectangular, circular or ellipsoidal cross-section, and having upper and lower ends, the lower end adapted for contacting a floor, support or additional base portion; a second housing portion having an inverted frustum shape with smaller and larger cross section ends, the smaller cross section end connected to the lower housing upper end; a third housing portion having a substantially vertical wall with upper and lower ends, the lower end connected to the larger frustum end and having the same cross section shape as the larger frustum end housing portion; a table top housing portion, having a lower surface connected to the third housing portion upper end, an upper surface defining a table top, the top housing portion further defined by an opening within the top housing portion, terminating in a flange at the opening, with an interference seal mounted on the flange; a dining panel insert having two parallel, opposite surfaces, fitted within and substantially flush to the table top surface with at least one utensil retaining device mounted on at least one panel surface; at least one hinge to connect the dining panel insert to the top portion, wherein, the dining panel insert is rotatable around the hinge to invert and reversibly seal the panel within the top portion opening to prevent washing fluid leakage when washing dishes; and at least one internal bulkhead mounted inside the housing, the bulkhead further defined by at least one opening, the bulkhead further adapted for mounting and connecting a dishwashing mechanism to an external utility.

In a second aspect of the invention, there is provided the housing of the first aspect, further comprising a frustum-shaped lower base portion having a larger lower cross section for contact with a supporting surface, and a smaller upper end cross section connected with the first vertical housing portion lower end.

In third aspect of the invention, there is provided dishwasher-dining table, comprising: a housing having inside and outside surfaces, the housing comprising a frustum-shaped lower base portion having a larger lower cross section for contact with a supporting surface and a smaller upper end cross section connected with a first vertical housing portion lower end; a first vertical housing portion having a rectangular, circular or ellipsoidal cross-section, and having upper and lower ends, the lower end adapted for contacting a floor, support or additional base portion; a second housing portion having an inverted frustum shape with smaller and larger cross section ends, the smaller cross section end connected to the lower housing upper end; a third housing portion having a substantially vertical wall with upper and lower ends, the lower end connected to the larger frustum end and having the same cross section shape as the larger frustum end housing portion; a table top housing portion, having a lower surface connected to the third housing portion upper end, an upper surface defining a table top, the top housing portion further defined by an opening within the top housing portion, terminating in a flange at the opening, with an interference seal mounted on the flange; a dining panel insert having two parallel, opposite surfaces, fitted within and substantially flush to the table top surface with at least one utensil retaining device mounted on at least one panel surface; at least one hinge to connect the dining panel insert to the top portion, wherein, the dining panel insert is rotatable around the hinge to invert and reversibly seal the panel within the top portion opening to prevent washing fluid leakage when washing dishes; and at least one internal bulkhead mounted inside the housing, the bulkhead further defined by at least one opening, the bulkhead further adapted for mounting and connecting a dishwashing mechanism to an external utility; at least one hinged, sealable, access door defined by an opening in at least one portion of the inverted frustum, a dishwasher control module and a detergent dispenser both mounted on the door inside surface; and a dishwasher mechanism mounted on the bulkhead in dishwashing relationship to the top insert panel.

The housing can be comprised of metals, polymers, ceramics or blends, mixtures or composites of them.

In a forth aspect of the invention, there is provided a method for constructing dishwasher-dining table comprising the steps of constructing a substantially rectangular or circular cross-section shaped lower housing portion, the housing having an upper edge and lower edge, the lower edge adapted to contact a support surface, the upper edge adapted to connect to an additional walled housing portion; constructing a frustum shaped, walled housing portion having a smaller frustum cross section lower end adapted to connect to the lower housing upper end and a larger frustum cross section upper end adapted to connect to a raised wall portion; constructing a bulkhead for mounting inside the housing, the bulkhead further defined by having at least one opening; constructing the raised wall portion shaped to connect to the upper cross section end of the frustum, constructing a top portion shaped to cover and connect the upper raised walled housing portion, the top portion further defined by an opening, the top terminating in a flanged portion at the opening; wherein dimensions defining the opening in the top are smaller than cross section dimensions of the raised wall portion; mounting a an interference seal on the flange; constructing a dining panel insert, the panel having two parallel surfaces and dimensioned so as to an interference fit within the top opening, against the seal, the panel further comprising at least one utensil retaining device mounted thereon; mounting at least one hinge to the outer top portion flange, mounting the dining panel insert on to the flange in the top opening, wherein, the panel is rotatable by 180 degrees around the hinge axis thereby allowing both parallel panel surfaces to form a substantially flat, reversibly sealed surface with the top portion; assembling the lower walled housing portion onto the smaller end of the frustum shaped portion, assembling the lower end of the upper walled housing portion onto the larger end of the frustum portion, assembling the top portion onto the upper walled housing portion upper end and assembling the top portion on to the upper end of the upper walled housing portion; mounting the bulkhead inside the assembled portions to provide a dishwasher-dining table housing and mounting the dishwashing mechanism on the bulkhead to provide a rotatable top dishwasher-dining table and constructing a frustum shaped base portion for distributing the weight of the dishwasher-dining table and resting a diner's feet and mounting the base portion on the lower end of the housing portion.

In a forth aspect of the invention, there is provided a method for cleaning dining utensils in a reversible top dishwasher-dining table.

DETAILED DESCRIPTION

Figure 1:
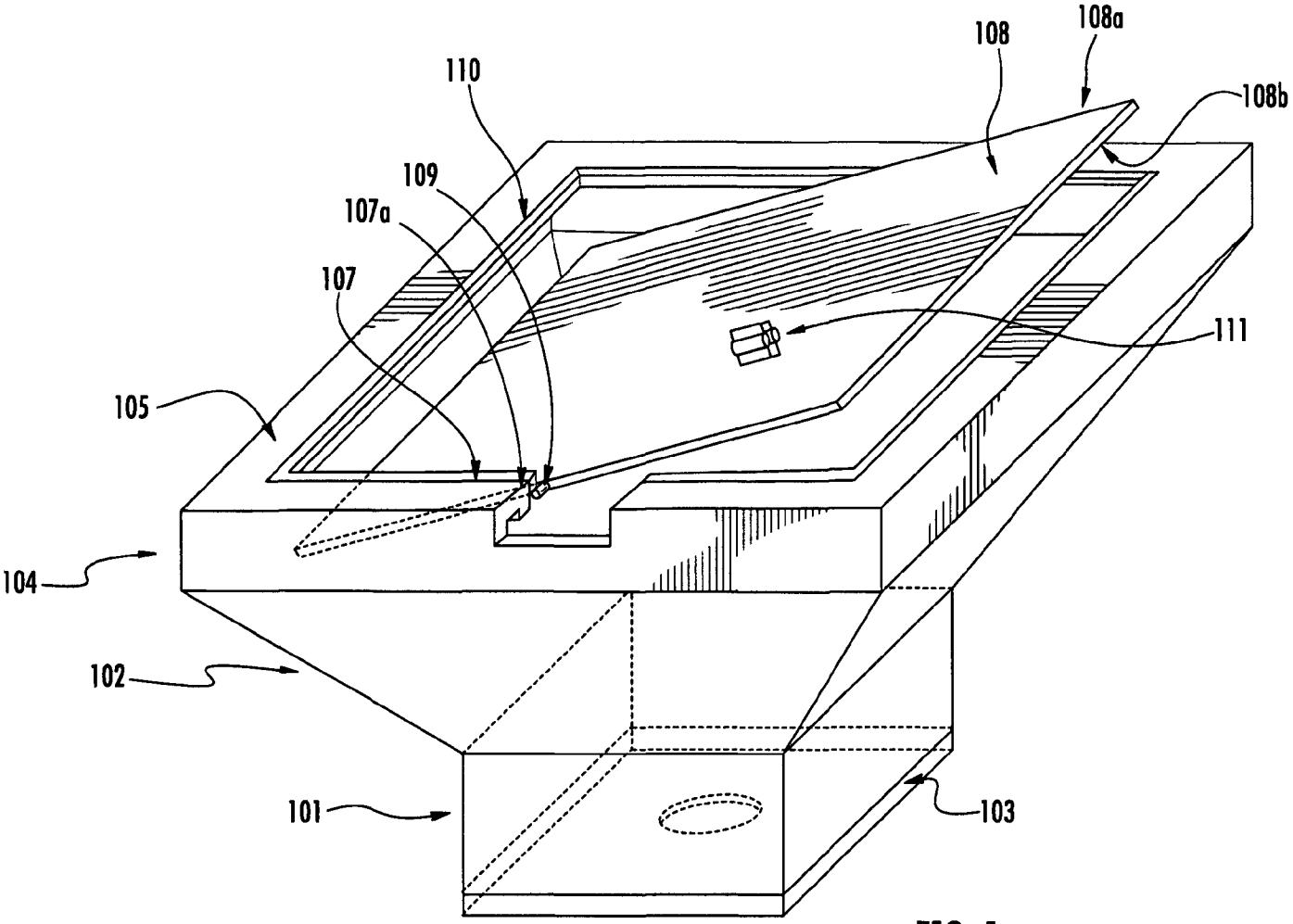
FIG. 1 illustrates a side view of an embodiment of the invention, including the rotatable top.

The principals of the invention will be described as they relate to an integrated an automatic dishwasher-dining table combination that incorporates a revolving or reversing dining table top having fixtures or other devices for retaining dining utensils such as plates, glasses, knives, forks, spoons, cups, and the like to be cleaned connected to the top against the gravitational field of the Earth. Generally, automatic dishwashers are known in the art. Non-limiting representative examples include: U.S. Pat. Nos. 2,750,611; 3,941,139, 4,038,103; 4,245,309; 5,017,852; 5,202,582; 5,448,115; 5,628,334; 6,605,157; 6,648,981 B2; 7,379,778 B2; 7,686,890 B2; 7,726,324; 7,837,802 B2 and 8,025,169 B2, the disclosures of each is expressly incorporated by reference into the present disclosure. Additionally, the disclosure of U.S. Pat. No. 3,005,282 is also expressly incorporated by reference into the present disclosure. The invention can be further understood by reference to the appended FIGS. 1-12. In a first embodiment, a dishwasher-dining table housing is shown in FIG. 1, and comprises a number of sections or portions having inside and outside surfaces, comprising 101*a* first housing portion having a rectangular or circular cross-section, having upper and lower ends, the lower end adapted for contacting a floor, support or additional base portion, 102 is a second housing portion having an inverted frustum-shaped with smaller and larger cross section ends, the smaller cross section end connected to the lower housing upper end. A "frustum", for the purposes of the present disclosure, is the shaped portion defined as the portion of a cone or a pyramid-shaped (walled section) that lies between two parallel planes cutting it. Or, (Merriam-Webster Online: Dictionary and Thesaurus; March, 2013), defines a frustum as the basal part of a (solid cone), or pyramid formed by cutting off the top by a plane parallel to the base. For the purposes of the present disclosure, a frustum portion is a walled, shaped portion of the housing (a walled housing portion) and can have 3 or more triangular or trapezoidal sides, preferably 8 or fewer sides and more preferably 4 or more sides and would have a rectangular cross section. A frustum shape can be a round or circular cross-section or included in the definition for the purposes of the present disclosure as an ellipsoidal cross section. Related to the present invention, the frustum shape describes embodiments where the base portion allows room for a diner's legs and feet and the increasing radius or diameter of the frustum shaped portion approximately defines the size of a table top from where eating utensils are placed and swept volume for allowing the rotating top portion to invert so that utensils may be cleaned. For the purposes of the present disclosure, the phrase "connected to" or "assembling" or "adapted to" refers to any method of connecting, shaping, or otherwise fabricating parts, portions, subsections or modules and connecting them to produce embodiments of the invention having substantially contiguous surfaces.

Embodiments of the invention can be produced or fabricated from separately fabricated sections or modules, from continuous sheet material or materials that can be cut, folded, bonded (welding (any type of welding; e.g. arc, heliarc, MIG, TIG, ultrasonic and the like), adhesive bonding, brazing, riveting and the like as would be useful to produce a substantially sealed modules, sections and completed sections suitable for constructing and assembling into a dishwasher housing), or composite or assembly. The completed dishwasher-dining table should function basically as a conventional automatic dishwasher, retaining water and washing solutions, heated or not. While the housing does not have to be "hermetically seal" per se, the portions, doors, insert portions should no leak liquid or spray or expel vaporized water and gases to any great degree which would impede using the device differently than any other automatic dishwasher. FIG. 1 further define one preferred location within the housing for the location of a bulkhead portion 103, that further is defined by having an opening for bringing external utilities connections into the appliance; the utilities including, but not limited to water, outgoing waste of soiled water, electrical power and the like. Additionally, the bulkhead portion can serve as a mounting for a dishwashing mechanism (whose construction is not particularly limited and generally standard within the industry, as described below), a disposal device, macerator, or other known device useful with the disposal of food and liquids removed from dining and cooking utensils. Continuing with FIG. 1, a third housing portion 104, has a substantially vertical wall with upper and lower ends, the lower end connected to the larger frustum end, and has approximately the same cross section shape and dimension as the larger frustum end, while the upper end can be of wider dimension, this portion has some vertical dimension that depends on the overall design of the entire housing and can vary from embodiment to embodiment. The third portion is adapted for receiving or connected to a tabletop housing portion 105, having a lower surface connected to the third housing portion upper end, an upper surface defining a table top, the top housing portion further defined by an opening with the top housing portion terminating in a flange or flange portion 107 at the opening with an interference seal 110 mounted on the flange. The term "connected" is meant to include any and all types of construction and manufacturing techniques and methods suitable for use in an automatic or electric dishwashing appliance such as, without limit: welding, folding, molding, adhesives, gluing, soldering and the like as would be known to those of skill in the art. The housing can be constructed of virtually any material possessing sufficient mechanical strength and stability, including, without limit: steel, coated steel, plastics and filled and structural/engineering plastics and composites, including layered composites, wood (such a teak) and the like. In a preferred embodiment, the housing can be constructed of ABS, polycarbonate-based material, polypropylene or similar plastic materials having similar physical and chemical properties. Preferably, the housing is constructed so that it will retain substantially all liquids and vapors introduced and generated during a washing cycle. For the purpose of the present disclosure, an "interference seal" is a seal or generally flexible material performing a sealing action that can provide an effective temporary or reversible seal between the top portion flange 107 and the dining panel insert 108 which is a dining panel insert having two parallel surfaces, fitted within and substantially flush with the table top portion 105, having at least one utensil retaining device mounted thereon. The flange 107 on table top portion 105, insert portion 108 and seal 110 forms a leak resistant or leak proof tabletop surface suitable for a dishwasher housing.

Figure 6A:
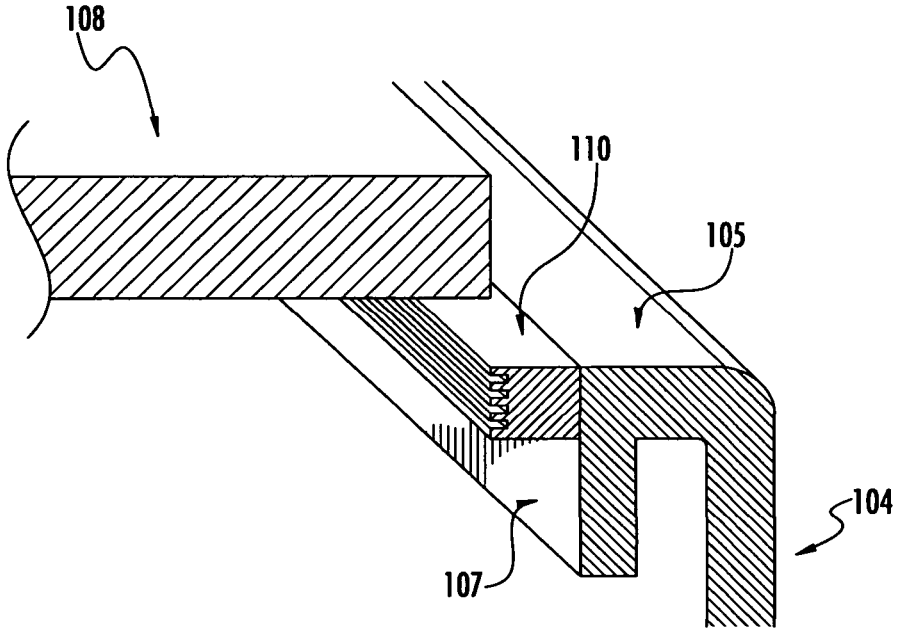
FIG. 6 illustrates an interference seal mounted on the flange and forming a reversible seal between the dining panel, the seal, and the flange and adapted to be reversibly sealable on a rotatable tabletop.
Figure 6B:
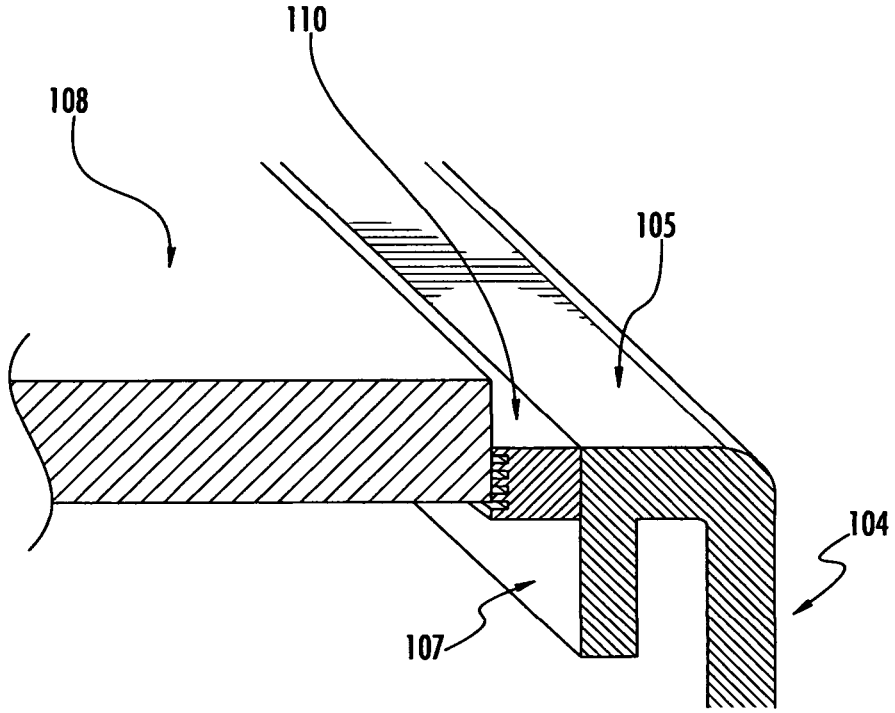
Figure 7:
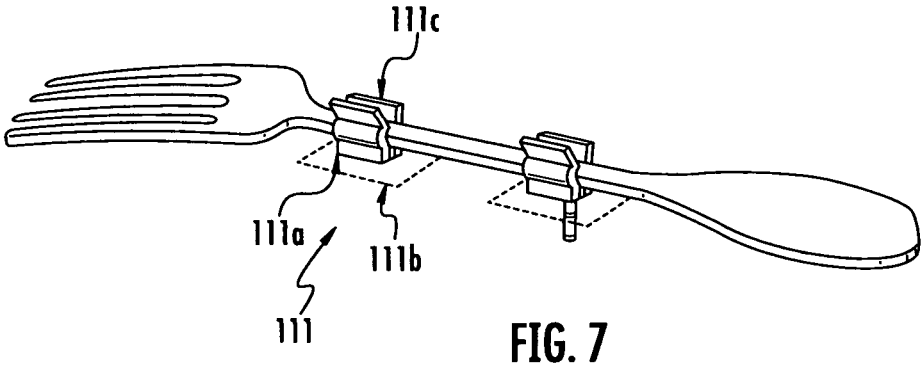
FIG. 7 is a side view of a clip adapted to reversibly attach a knife, fork or spoon onto the dining panel portion of a rotatable tabletop.
Figure 8:
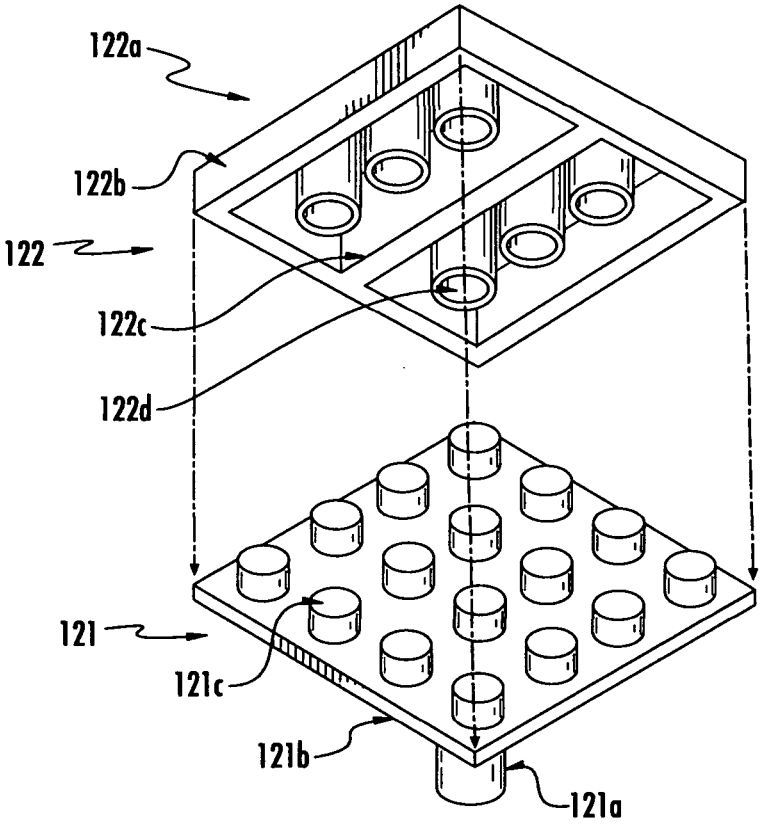
FIG. 8 illustrates a perspective view of an embodiment of an interference retaining bracket pair for reversibly retaining glasses, cups dishes and the like mounted on a dining panel insert.
Figure 9:
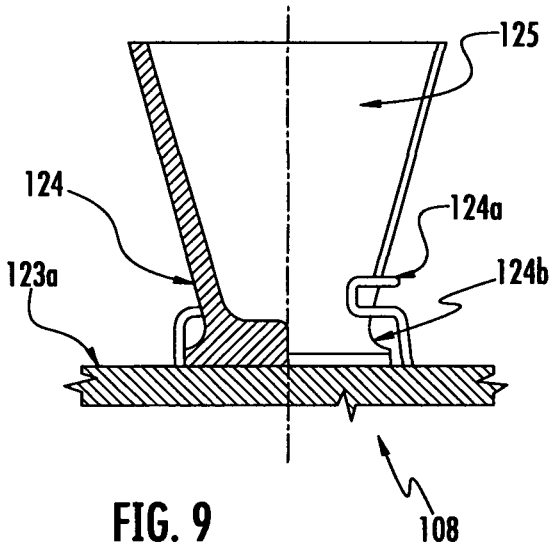
FIG. 9 is a side view of a shaped wire retaining bracket and a drinking glass retained on the surface of a dining panel.
Figure 10:
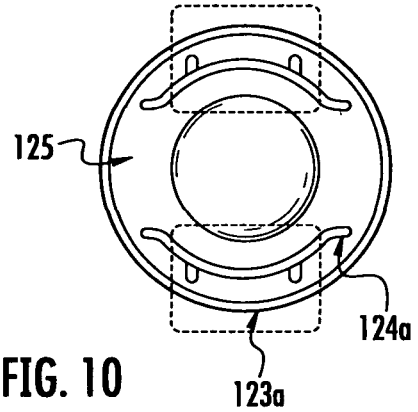
FIG. 10 is a top view of a shaped wire-retaining bracket and a drinking glass retained on the surface of a dining panel insert.

The seal performs several functions: first, it stabilizes the dining portion in an essentially coplanar relationship with the top portion and secondly, but of prime importance, limits or prevents passage or leakage of washing detergents and the like out of the housing. The seal construction and material is not so important so long as these two aforementioned functional requirements are met. But, the seal can be any suitable material such as polymers, plastics, composites, blends of rubbers, elastomers, polymers that are natural or synthetic and that may include fillers, reinforcing or not, such as, but not limited to: fiber fillers (glass or polymeric), particulates such as silica, carbon black (particles, nanoparticles or tubes, etc.) and the like. Preferred seal materials include silicon and silicon-composite materials, EPDM, neoprene, natural rubber, metal and metal-rubber composite seals, thermoplastic olefins (TPO) such as Santoprene™. The design of the seal can be any design that facilitates the functional requirements of achieving a seal to washing fluid leakage. Manufacturers of suitable seals include, for example: Vanguard Products Corporation, 87 Newtown Road, Danbury, Conn. 06810P, United States of America. Preferably the seal works by an interference fit and functions suitably in a slidable relationship with the dining panel portion. One preferred seal design is a so-called lip seal; most preferably the lip seal is a multiple-lip seal as shown FIGS. 6*a* and 6*b*, the seal having a number of extended parallel lip portions that are flexible but sufficiently resilient and allow the insert portion to move past the seal on the top portion when the dining panel insert is rotated. FIGS. 6*a* and 6*b* illustrate upper vertical portion 104, top portion 105, flange 107, rotatable dining panel 108 and the multiple-lip interference seal 110 in reversible sealable position with the top portion and in a partially open position, 6*b*. Other useful seal profiles or shapes include cross sections of "D" or "O" shape and the like as may be determined by one of ordinary skill in the art. The seal and dining portion are profiled so they fit together in a "snap" or "pop" mechanical interference fitment whereby either the seal or dining portion edge profiles are of complimentary shape so that the dining portion is mechanically stabilized so as to form a stable dining surface. The degree or tightness of seal fit can vary so long as washing liquids are prevented from escaping the housing during a washing cycle. Such seals can be made by various known extrusion and compressing molding techniques as know to those of skill in the art. The dining panel insert, FIG. 1 at 109 and FIG. 4, at 109 illustrates at least one hinge to connect the dining panel insert to the top portion, wherein, the panel can be rotated around the hinge axis to expose and reversibly seal the panel's opposite side to prevent washing fluid leakage when washing dishes. The panel can be constructed of the same or different materials as the other parts or portions of the housing. The panel can preferably be constructed from polymeric materials such as polycarbonate, ABS, polyvinyl chloride and other engineering or structural plastics. The panel can comprise filled materials to improve physical properties such as heat distortion temperature, abrasion resistance and the like as would be known in the art. The dining panel insert can be manufactured using a molding technique such as compression sheet molding, injection molding, blow molding and the like. Mounted on the dining panel insert is at least one dining utensil-retaining device 111. Non-limiting examples of utensil retaining devices useful in the present invention include those as illustrated in FIGS. 7, 9 and 10, which are disclosed in U.S. Pat. No. 2,750,611 and are incorporated by reference, except and FIGS. 8 and 11 that are adaptions of interference connectors disclosed and incorporated by reference, above from U.S. Pat. No. 3,005,282.

Figure 11:
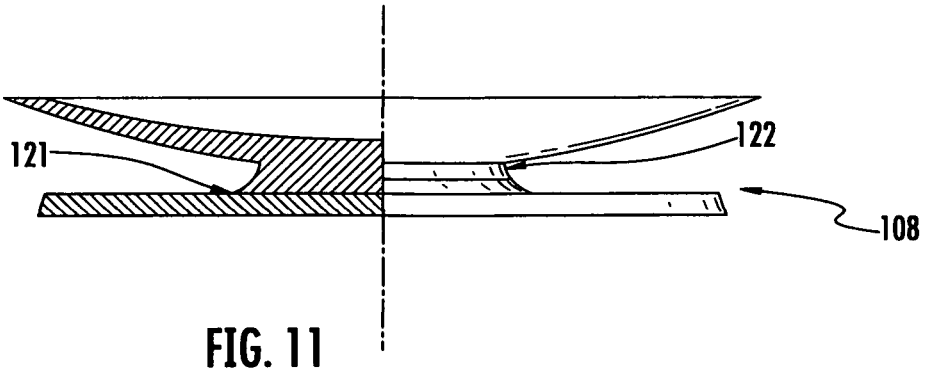
FIG. 11 is a perspective of a dish incorporating the interference retaining bracket pair disclosed in FIG. 8 to reversibly attach a dish or other dining utensil onto the top of a rotatable top: bracket 122 is attached to a utensil bottom and bracket 121 is attached to a dining panel surface by inserting 121*a* into the panel.
Figure 12:
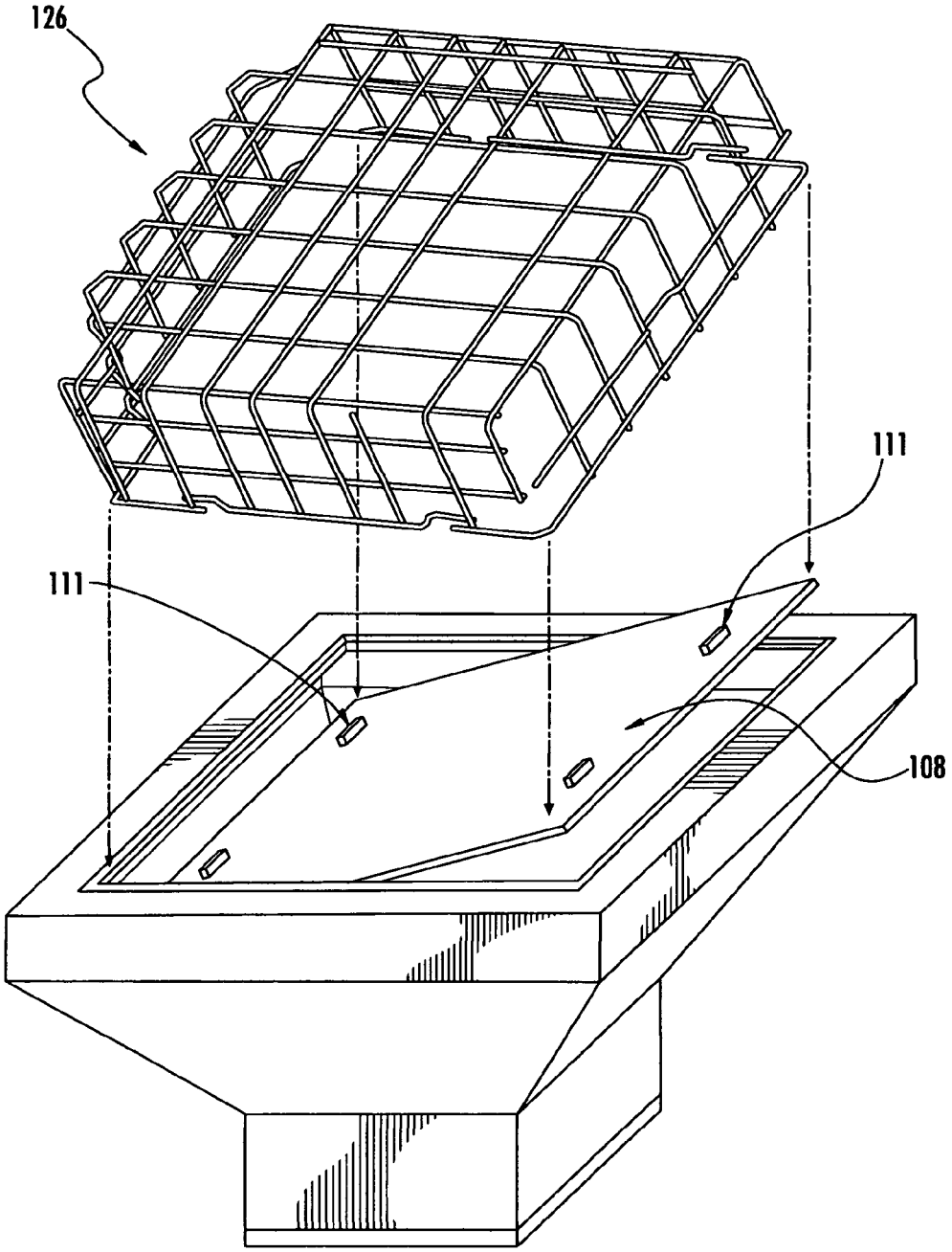
FIG. 12, is a perspective view of an auxiliary safety basket for attaching to a dining panel portion to provide for additional space to wash cooking utensils not provided for by panel attachments.

FIG. 7 is a side view of a semi-cylindrical clip 111 having a pair of angled sides 111*c* and 111*b* on mounting stud 111*a* (which can be inserted into dining panel portion 108), and which can be adapted to reversibly attach a knife, fork or spoon onto the dining panel portion 108 using springing tension and sufficiently retain the utensil to the surface so that the utensil can be cleaned. FIG. 8 illustrates an interference connector to reversibly mount glasses, dishes and the like onto dining panel 108. The connector comprises two parts, lower base 121 and upper clip 122; 122 for attaching to a dish, cup or glass by adhesive (that can be a temporary adhesive): 121 comprises stud 121*a* for attaching the base to a dining panel 108, which connects platform portion 121*b* having relatively stiff or rigid raised cylindrical portions or pips 121*c*. Portion 122, under hand force, reversibly attaches to base 121 by interference fitment using slight deformations of cylindrical pins 122*d* and wall 122*b*; the portion is shown in this embodiment with a central divider 122*c* for improved rigidity. The clip (and any other utensil retaining device) can be attached to either panel surface 108*a* or 108*b* by any conventional technique including, screws, adhesives, insert connectors and the like as known in the art. The panel 108 can be designed to include threaded inserts (e.g. "T-nuts") or insert moldings and the like (illustrated in FIGS. 9 and 10 in hidden view at 123*a* to receive threaded utensil retaining devices or other utensil retaining devices (for example, loop and hook type connectors may be used). These connectors may also be reversibly attachable to facilitate rearrangement of utensils on the dining panel insert as required by meal being served. FIG. 9 is a side view of a shaped wire-retaining bracket for retaining a drinking glass or other utensil on the surface of a dining panel having t-nut connector 123*a* is imbedded in panel 108 and having a glass 125 held by wire connector shaped to retain the same and having portions attached depending from 123*a*, portion 124*b* and 124*a* as parts of 124. FIG. 10 is a top view of the shaped expandable wire-retaining bracket, and a drinking glass, retained on the surface of a dining panel 108 shown in FIG. 9. Other kinds and types of connectors can be used as desired. The connector can be attached to illustrates a side view of one embodiment of a two-piece, interference connector system for reversibly retaining suitable glasses, cups, dishes and the like. FIG. 11 is a side view of assembled interference connectors 120 and 121 in FIG. 8, attached to a dining dish and mounted on dining insert panel 108. FIG. 12 is an illustrative perspective view of a reversibly attachable auxiliary safety basket 126 for preventing a utensil from falling from the dining panel into a dishwashing mechanism or providing additional area to wash other soiled utensils, for example, pots and pans used to prepare meals, easily washed in conjunction with the dining utensils. Basket 126 makes use of utensil retaining clips 111 as a retention device. The basket can be made of any useful material (e.g. plastic, metal, etc.), mesh size, wire diameter and height above the dining panel insert 108 so long as the combination of panel and basket will allow for operation of the rotatable top into a dishwashing washing position (that is, the utensils being upside down, inside the housing, to receive a washing).

The hinge can be any known type of hinge that will function with a dishwasher housing. Preferably the hinge is a pin hinge whose preferred design is shown in 107*a, b* and *c*. The compression pin of 107 comprises a telescoping pair of pin hinge bodies adaptable to fit into the dining panel insert portion 108 and the top portion at the flange 107 through interference seal 110. The pin hinge provides for straight forward mounting of the dining panel portion into the top portion and the hinge supports and connects the dining table portion to the top portion module so that the dining table portion can be rotated through a rotation of 180 degrees about the hinge axis to expose the opposite parallel dining area or other flat surface (e.g. a smooth surface suitable for table use). In practice, the hinge pen is inserted thru the dining panel portion, compressed, and inserted into the top portion. The pin hinge 109 can be constructed of any known material useful for hinges. In a preferred embodiment, the body portions are made from stainless steel and the spring made from a resilient, compressible, plastic or stainless steel. The pin hinge pivot can be a single side penetrating pin or rod which is inserted into the top panel so as to connect the dining panel 108 to the top 105 through seal 111 on opposite sided of the opening in top 105.

Figure 2:
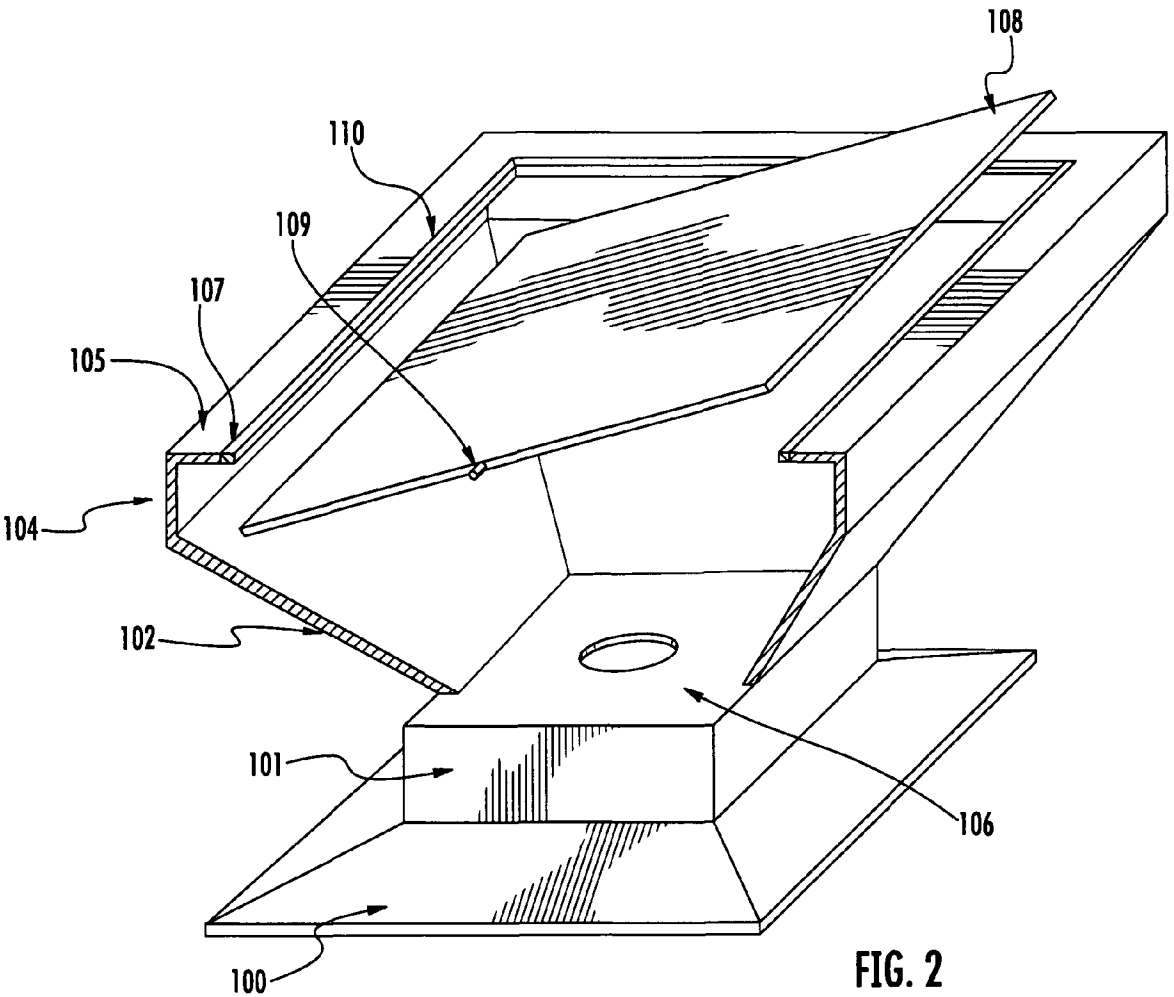
FIG. 2 illustrates a cutaway view of one embodiment of the invention which shows how the top rotates to invert the dining panel insert and one type of hinge (pin hinge) to connect the dining portion to the housing through the seal mounted on the outer top portion.

FIG. 2 illustrates another preferred housing embodiment also incorporating the elements of FIG. 1. FIG. 2 illustrates a cutaway view of a housing and includes at 100 a frustum-shaped lower base portion having a larger lower cross section for contact with a supporting surface thereby lowering the force per unit area on a support surface and providing a rest area for a diner's feet, and a smaller upper end cross section connected to first vertical housing portion 101 connected to inverted frustum shaped portion 102, substantially vertical walls portion 104, top portion 105, and bulkhead 106 in an alternate position within the housing, located in between the first vertical portion and the inverted frustum portion. The bulkhead can be used to mount any component useful in the interior of a conventional automatic dishwasher. A so-called "dishwashing mechanism", a number of which have been incorporated by reference, above, may be mounted above, below or incorporated within a bulkhead of the present invention. As in FIG. 1, FIG. 2 illustrates flange 107, dining portion 108, shown fully with pin hinge 109 in position so as to allow panel 108 to be rotatable by at least 180 degrees around the hinge pivot point 109, which inserts into flange portion 107*a* in FIG. 1 which can be a recess pocket of hole milled or drilled into the flange portion or top portion 105 through seal 110. The panel 110 can be rotated by hand force thereby allowing for a simple design and operation. A mechanical mechanism (powered or manuel) to rotate the top panel 110 is also within the scope of the present invention, however, its inclusion is not required for successful operation. Where desirable, embodiments of the invention can be configured with a drive mechanism (gear drive (helical, worm, track, spur, bevel and the like), belt, wire and the like) that connects hinge pivot 109 to a DC or AC motor (directly or indirectly), which may or may not be interconnected and thur coordinated with a dishwasher mechanism and a washing cycle by either computer logic circuit(s) as would be known to one of ordinary skill in the art, or simple circuit and switch arrangements, which may provide for initiation of top panel 110 rotation that may be coordinated with a washing cycle. Electric motors may be placed in driving arrangement with various mechanisms in the flange portion 107 or internal or external to a dishwasher-table top housing: such motor and mechanism placement is not particularly limited and may be as convenient. Also, a hand-cranked or motor driven mechanism depending from pin hinge 109 through flange portion 107 and exiting through top 105 or from substantially vertical walls portion 104 is shown in FIG. 3.

Figure 4:
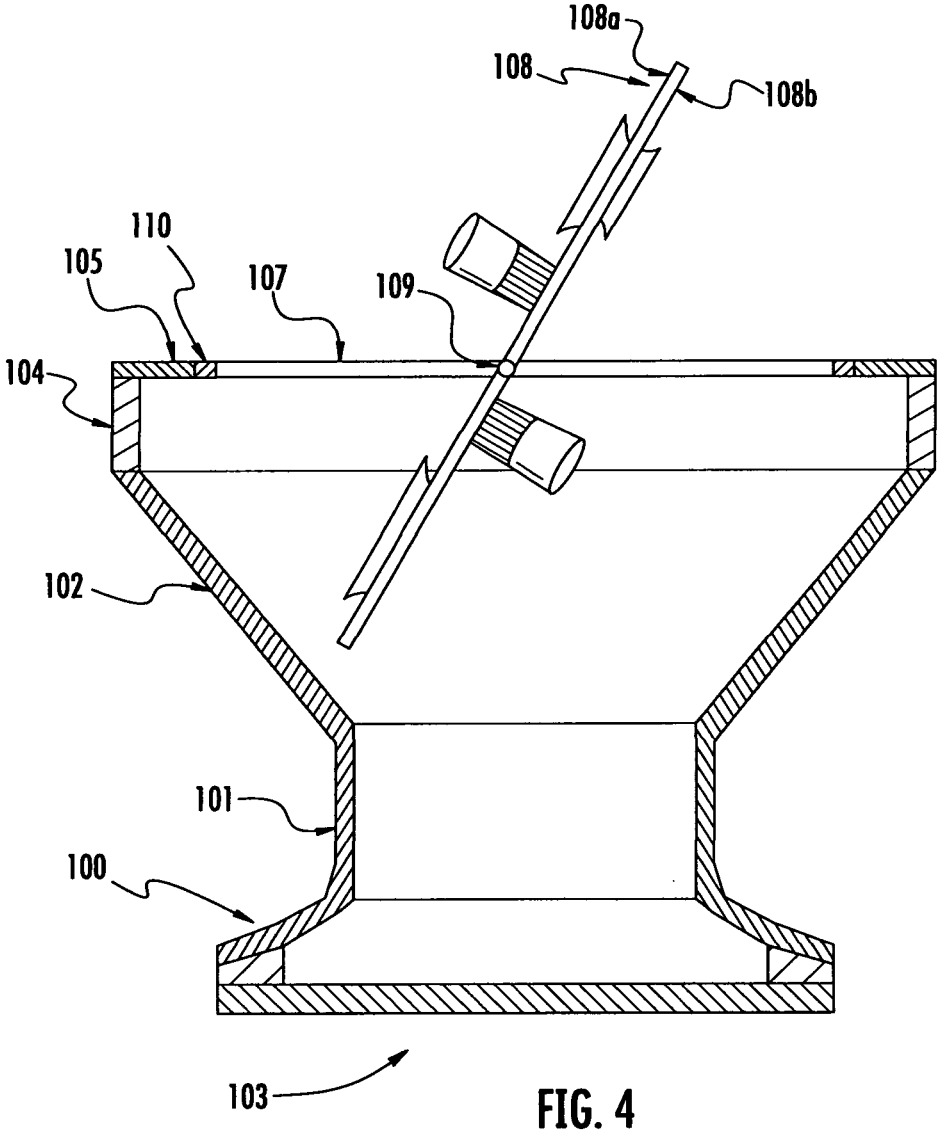
FIG. 4 is a cross section cutaway view of one embodiment of the invention illustrating how the dining portion, with dining utensils mounted thereon, rotate through the inverted frustum portion of the housing to invert the dining panel for washing soiled utensils.

FIG. 4 further illustrates the embodiment shown in FIG. 2, in section view: 103 is a bulkhead, 100 a lower frustum portion, 101*a* first vertical base portion, 102 is the inversed frustum portion, 104 the upper vertical portion, 105 the top portion, 110 the seal portion, 107 the flange portion minus seal, 109 the pivot pin, side view, 108, 108*a* and 108*b* the rotatable top portion in rotatable relationship mounted in the housing with two parallel and opposite sides. The relationship of the top rotating through the housing illustrates how the swept volume (the volume of space in which the top portion occupies on rotation) determines the minimum dimensions of the portions, relative to the size of the top portion, for the top to rotate at least 180 degrees in the housing.

Figure 5:
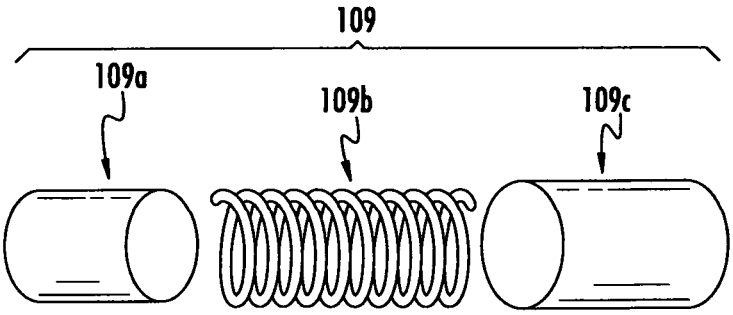
FIG. 5 illustrates one type of pin hinge containing a compression spring for reversibly mounting the rotating top.

FIG. 5 is an exploded view of one hinge pin 109 embodiment useful in the embodiments of the invention. It incorporates a compression spring 109*b* which is compressed in telescoping housing portions 109*a* and 109*c* wherein the assembly, regardless of length, can be compressed for ease of insertion into and/or through the top portions and into flange 107. An embodiment can be of any useful length and of sufficient strength so that the entire dining panel is supported by a single pin hinge or the pin hinge can be doubled, one on either opposite of the dining panel portion or a long, single hinge pin traversing the entire dining panel (not shown) can be used. The hinge pin can be configured with a mechanism to receive the force from a motor, preferably an electric motor, cordless or AC powered to transfer motive force to rotate and invert the dining insert panel. Many such mechanisms are known to those of skill in the art and are considered as equivalent for the purposed of the present invention. Other hinge mechanisms as would be known to those of skill in the art to be useful are considered to be within the scope of the invention.

Figure 3:
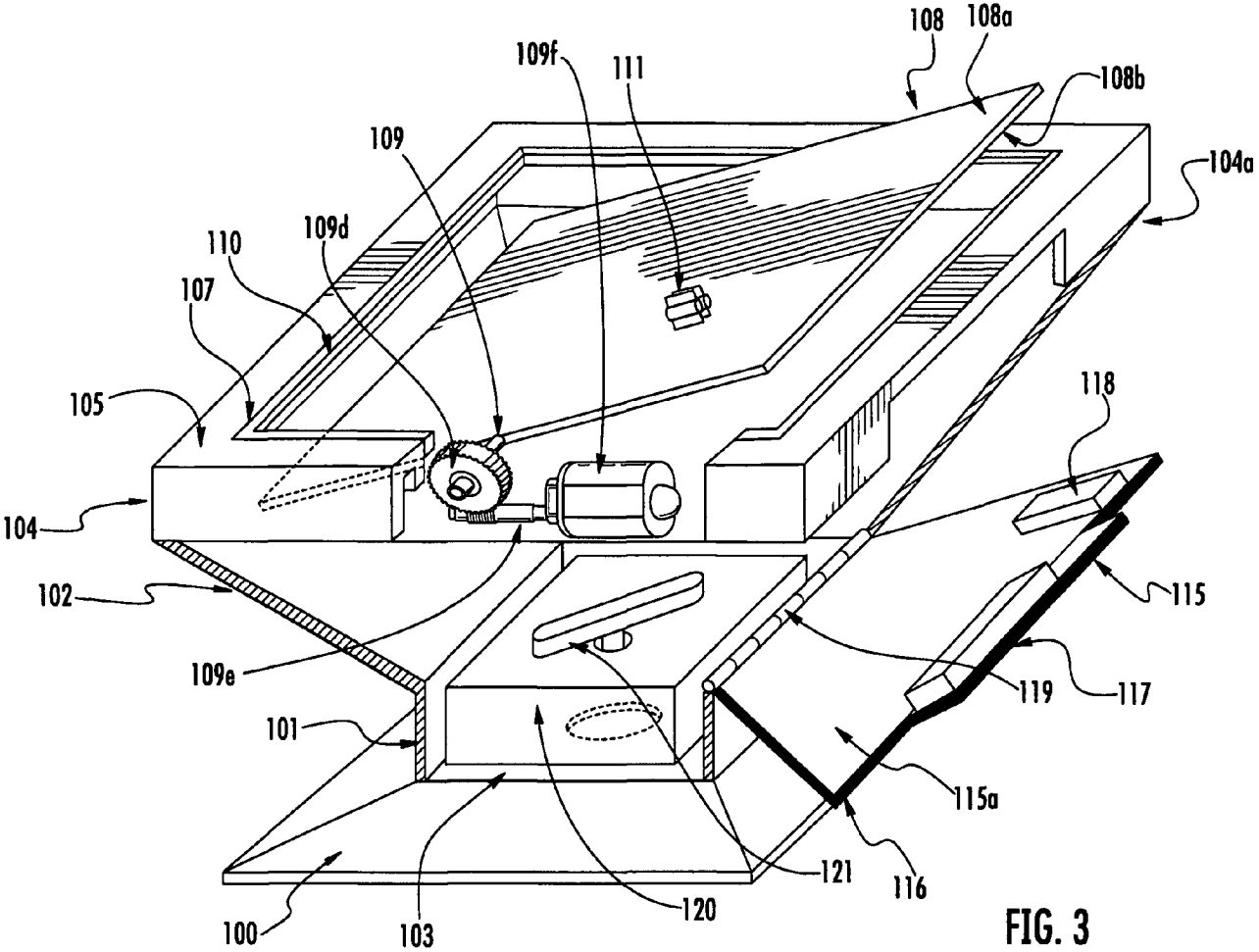
FIG. 3 illustrates a cutaway view of the dishwasher dining table combination having an access door and dishwashing mechanism mounted on the bulkhead.

FIG. 3, discloses a preferred embodiment, in cutaway view, of the housing and includes a representation of generic dishwashing mechanism 120 and a motor-driven dining insert panel rotation mechanism. FIG. 3 incorporates the basic housing of FIGS. 1 and 2 and adds several elements. Included in a dishwasher dining table preferred embodiment are a dishwasher-dining table, comprising: a housing having inside and outside surfaces, the housing comprising a frustum-shaped lower base portion 100, a first vertical housing 101 connected to the lower base portion 100 and a bulkhead 103 connecting to 101; a second housing portion having an inverted frustum shape 102 connected to the first vertical housing portion upper end; a forth housing portion having a substantially vertical wall 104, connected to the larger frustum end; a table top housing portion 105, having a lower surface connected to and covering 104, with 105 having a flange 107 at the opening with an interference seal 110 mounted on the flange 107; dining panel insert panel 108 (with opposite parallel surfaces 108*a* and 108*b*) with hinge pen 109 (partially hidden in view) and includes a motor drive 109*f* connecting to a worm gear shaft 109*e* which drives sprocket 109*d* which is connected to hinge pin 109, the drive providing motive force to rotate the panel insert 108. In practice, any suitable AC or DC motor and drive mechanism can be used and the location and configuration of the motor drive connected to the top is not particularly important so long as the other components perform as desired. The motor may be connected to the dishwasher control mechanism 117 as would be known to one of skill in the art, and various operating sequences, including sequencing the top rotation in timing with a utensil washing cycle, as would be known to one of skill in the art, is included within the scope of the invention. Suitable motor drives are typically high in torque and operate at low speeds. The starting and stopping of the top rotation may or may not be controlled by separate circuits that contain a safety cutoff mechanism, for example a micro switch mounted on flange 107 or top portion 105 as configurable by one of ordinary skill in the art. FIG. 3 includes at least one hinged 119 sealable access door 115 defined by an opening in at least one portion of the inverted frustum portion 102, and defined by a partial opening in vertical portion 104*a*, the door 115 further includes a seal 116, a dishwasher control module 117, mounted on the door 115 and a detergent dispenser 118 mounted on the door inside surface 115*a*. An automatic dishwashing mechanism ("dishwasher") 120 can be any device that will provide a pressurized supply of cleaning fluids (water, solvents, detergents and the like, useful for cleaning dining utensils) upward and impinging on the inverted dining panel portion onto which dining and cooking utensils are retained so that the utensils are effectively cleaned of the food and contaminants encountered during food preparation and consumption. The materials and construction techniques for embodiments of FIG. 3 are the same as those discussed in conjunction with embodiments disclosed in FIGS. 1 and 2, above. The dishwasher mechanism and manner of operation is not particularly limited so along as the above criteria are met; that is, the utensils, dishes, pots, drinking vessels, etc. are cleaned to a degree as would be acceptable from a conventional automatic dishwasher. A particular useful class or type of dishwashing mechanism, combined in an embodiment of the present invention (the housing), is U.S. Pat. No. 3,941,139 to Spiegel, the entire disclosure of which is herein expressly incorporated by reference. Spiegel includes a rotatable spray dispersing device (shown in FIG. 3, 121) or assembly in fluid communication with a pressurized source of washing liquid and a plurality of nozzles thereon for directing wash liquid throughout the washing housing in order to clean the utensils. A dishwasher mechanism typically includes a pressure pump to force washing and cleaning liquid up onto the utensils for cleaning, a process or washing sequence control module (exemplified by 117 for washing utensils according some known predetermined sequence or cycle, which can be any known sequence, or method known in the art.) The controls on module 117 are not particularly limited and are known in the art and incorporated by references, above. In operation, the utensils are initially placed on the table and connected to the connection devices (e.g. 111) and a meal consumed. After dining, the top is rotated and sealed into the washing position, by hand, or initiation of the motor drive, and any known wash sequence begun after detergent is added to either the inside of the housing or into a sequenced dispenser 118. After a wash sequence has terminated, the top is rotated back into the dining position to provide cleaned eating utensils. The "bottom" of the insert panel may or may not comprise utensil retaining devices and may be of a smooth surface, such as glass or scratch resistant plastic, decorative wood panel and the like whereby when utensils are being washed, the opposite panel can be used as a regular table top.

In a preferred method or process of manufacturing an embodiment of the dishwasher-dining table, in particular embodiments as disclosed in FIGS. 1-4, a series of modules or portions corresponding to the individual sections or housing portions are first constructed and subsequently assembled into a dishwashing housing. Included in assembling a housing are conventional materials and techniques used in constructing vessels that contain heated water and cleaning detergent solutions. That is, sections may be attached or joined through using gaskets, caulks, adhesives, glues of any useful kind or type known in the art. Further, included in these steps are: constructing a substantially rectangular or circular cross-sectioned-shaped lower housing portion, the housing having upper and lower ends, the lower end adapted to contact a support surface, the upper end adapted to connect to an additional walled housing portion; constructing a frustum shaped walled housing portion having a smaller frustum cross section lower end adapted to connect to the lower housing upper end and a larger frustum cross section upper end adapted to connect to a raised wall portion; constructing the raised wall portion shaped to connect to the upper cross section end of the frustum, constructing a top portion shaped to cover and connect the upper or second raised walled housing portion, with the top portion further defined by an opening, the top terminating in a flanged portion at the opening wherein dimensions defining the opening in the top are smaller than cross section dimensions of the raised wall portion; mounting an interference seal on the flange; constructing a shaped dining panel insert, the panel having two parallel, opposite surfaces and dimensioned to fit with a reversible interference fit against the seal within the shaped top opening, the shaped dining panel insert further comprising at least one utensil retaining device mounted thereon; connecting the outer top portion flange to the dining panel insert by at least one hinge, wherein, the panel when placed in the opening adjacent the seal, is rotatable by 180 degrees around the hinge thereby allowing either parallel dining panel surface to form a substantially flat, reversible interference fit sealed surface top portion assembly; connecting or assembling the lower walled housing portion onto the smaller end of the frustum shaped portion, assembling the lower end of the upper walled housing portion onto the larger end of the frustum portion, assembling the top portion onto the upper walled housing portion upper end and assembling the top portion on to the upper end of the upper walled housing portion; constructing and mounting at least one bulkhead inside the housing, the bulkhead further defined by having at least one opening; to provide a dishwasher-dining table housing and mounting a dishwashing mechanism in or on the bulkhead or housing to provide a rotatable top dishwasher-dining table. The construction method can further comprise the step of constructing an additional frustum shaped base portion for distributing the weight of the dishwasher-dining table and mounting the frustum shaped base portion (in normal frustum-orientation—large end down) on the lower end of the lower housing portion. The method can include adding at least one hydrophobic layer or coating added onto the assembled housing to facilitate draining of washing solution or liquids back down into the lower portions of the washing mechanism for removal from the housing. The construction method can also include configuring a wide area network device onto the washer as is well known in the art and connecting it to an electronic control mechanism for communicating and controlling the dishwasher dining table through a computer or other electronic control device, preferably a distance isolated computer or electronic control device. The construction method further comprise constructing a frustum shaped bottom portion for distributing the weight of the dishwasher-dining table and resting a diner's feet. The method can comprise the steps of constructing the housing from a metal, plastic, polymer, composite, ceramic, glass component, blend, mixture or composite thereof. The method may comprise constructing the dishwasher-dining table of a plastic or polymer is a high impact, high temperature stable plastic or composite as noted in the description of various embodiments of the invention. The method of constructing the housing and associated parts and components can comprising constructing the housing or housing portions by molding techniques which are not particularly limited but include: blow molding, injection molding, rotational molding or combinations thereof as known in the art.

In practice, the dishwasher can be operated by any number of sequences. A preferred sequence includes the steps of: placing at least one utensil on the table top into a utensil retaining device mounted on at least one panel surface; rotating inverting the insert panel and reversibly sealing the insert panel into the washing position, starting a utensil cleaning sequence in the dishwashing mechanism thereby washing the utensils, reversing the insert panel position to provide cleaned utensils ready for using after termination of the washing sequence.

While the invention has been described in connection with what is presently considered to be the most useful and preferred embodiment, it is to be understood that the invention is not to be limited to the disclosed embodiments, but on the contrary, is in tended to cover various modifications and equivalent arrangements included within the sprint and scope of the appended claims.

The claimed invention is:

1. A dishwasher-dining table housing having inside and outside surfaces, comprising:

(a.) a first vertical housing portion having a rectangular, circular or ellipsoidal cross-section, having upper and lower end, the lower end adapted for contacting a floor, support or additional base portion;

(b.) a second housing portion having an inverted frustum shape with smaller and larger cross section ends, the smaller cross section end connected to the lower housing upper end;

(c.) a third housing portion having a substantially vertical wall with upper and lower ends, the lower end connected to the larger frustum end and having the same cross section shape as the larger frustum end housing portion;

(d.) a table top housing portion, having a lower surface connected to the third housing portion upper end, an upper surface defining a table top, the top housing portion further defined by an opening with the top housing portion terminating in a flange at the opening with an interference seal mounted on the flange, wherein housing portions a, b, c, d, in order, are connected;

(e.) a single dining panel having only two parallel, opposite surfaces, fitted within and substantially flush to the table top surface with at least one utensil retaining device mounted on at least one panel surface wherein the single dining panel and housing portions are proportioned to accommodate two or more diners;

(f.) a flexible interference seal mounted around substantially the entire perimeter of the flange or dining panel, the interference seal having a partially shaped edge profile whereby a slidably reversible, leak resistant connection between the flange and dining panel is maintained, wherein the dining table is mechanically stabilized to form a stable dining surface by only a mechanical interference fitment between the interference seal, and the flange and the dining panel;

(g.) at least one hinge to connect the dining panel to the top portion, wherein, the dining panel insert is rotatable around the hinge to invert and reversibly seal the panel within the top portion opening to prevent washing fluid leakage when washing dishes; and (h.) at least one horizontal bulkhead mounted inside and integrated with the first vertical housing portion such to fluidly seal a lower portion of the housing, the bulkhead having defined therein at least one opening to pass a utility connection, the first vertical housing portion, and the bulkhead further adapted to receive and mount a rotatory arm, spray-dispersing, dishwashing mechanism for connecting to the utility connection.

2. The dishwasher-dining table housing of claim 1, further comprising: a frustum-shaped lower base portion having a larger lower cross section for contact with a supporting surface, and a smaller upper end cross section connecting with the first vertical housing portion lower end.

3. The dishwasher-table housing of claim 1 wherein the lower housing portion has a rectangular cross-section, circular or oval cross-section.

4. The dishwasher-dining table housing of claim 1 wherein the housing or housing portions are molded, wherein the molding technique is selected from blow molding, injection molding, rotational molding or combinations thereof.

5. The dishwasher-dining table housing of claim 1, further comprising an electric motor drive and drive mechanism for rotating the dining panel insert into a utensil washing position.

6. The dishwasher-dining table housing of claim 5 wherein the drive mechanism includes a worm and spur gear drive and the electric motor runs on alternating current.

7. The dishwasher-dining table housing of claim 1 wherein the single dining panel and housing portions are proportioned to accommodate two to 8 diners, inclusively.

8. A dishwasher-dining table, comprising: a housing having inside and outside surfaces, the housing comprising:

(a.) a frustum-shaped lower base portion having a larger lower cross section for contact with a support surface or floor, a smaller upper end cross section;

(b.) a first vertical housing portion having a rectangular, circular or ellipsoidal cross-section, having upper and lower ends, the lower end connected to the lower base portion upper end;

(c.) a second housing portion having an inverted frustum shape with lower smaller and larger upper cross section ends, the smaller cross section end connected to the first vertical housing portion upper end;

(d.) a third housing portion having a substantially vertical wall with upper and lower ends, the lower end connected to the larger frustum end, having the same cross section shape as the larger frustum end;

(e.) a table top housing portion, having a lower surface connected to and covering the third housing portion upper end, having an upper surface defining a table top, the top housing portion further defined by an opening with the top housing portion terminating in a flange at the opening; wherein housing portions a, b, c, d in order, are connected;

(f.) a single dining panel having only two parallel and opposite surfaces, fitted within and substantially flush with the table top portion surface, having at least one utensil retaining device mounted thereon, wherein the single dining panel, housing portions are proportioned to accommodate two or more diners;

(g.) at least one hinge to connect the dining panel insert to the top portion, wherein, the panel can be rotated around the hinge axis to expose and reversibly seal the opposite parallel side of the dining panel insert to prevent washing fluid leakage when washing dishes or utensils;

(h.) at least one horizontal bulkhead mounted inside and integrated with the first vertical housing portion such to fluidly seal a lower portion of the housing, the bulkhead having defined therein at least one opening to pass a utility connection, the first vertical housing portion and the bulkhead further adapted to receive and mount a rotatory arm, spray-dispersing; dishwashing mechanism for connecting to the utility connection (i.) at least one hinged sealable access door defined by an opening in at least one portion of the inverted frustum portion, a dishwasher control module mounted on the door and a detergent dispenser mounted on the door inside surface;

(j.) at least one rotatory arm, spray-dispersing dishwasher mechanism mounted to the horizontal bulkhead in the first vertical portion, in dishwashing relationship to the top insert panel inverted surface portion, and (k.) a flexible interference seal mounted around substantially the entire perimeter of the flange or dining panel, the interference seal having a partially shaped edge profile whereby a slidably reversible, leak resistant connection between the flange and dining panel is maintained, wherein the dining table is mechanically stabilized to form a stable dining surface by only a mechanical interference fitment between the interference seal, the flange, and the dining panel.

9. The dishwasher-dining table of claims 8 wherein the housing is comprised of a metal, polymer, ceramic, glass or blends, mixtures, composites or laminates thereof.

10. The dishwasher-dining table of claims 9, wherein the polymer is an engineering polymer or plastic.

11. The dishwasher-dining table of claim 8, wherein the seal comprises a synthetic or natural polymer, rubber, elastomeric or composite material.

12. The dishwasher-dining table of claim 8, further comprising an electronic dishwasher control mechanism for sequencing the washing of cooking and dining utensils, the control mechanism mounted on the dishwasher housing and connected to the dishwashing mechanism.

13. The dishwasher-dining table of claim 12 further comprising a wide area network device connected into the electronic control mechanism for controlling the dishwasher-dining table through a computer or other electronic control device.

14. The dishwasher-dining table of claim 8, further comprising: a reversibly attachable auxiliary safety basket and a plurality of utensil safety clips attached to the dining panel insert to secure the reversibly attachable auxiliary safety basket to the dining panel insert.

15. The dishwasher-dining table of claim 8 wherein the single dining panel and housing portions are proportioned to accommodate two to 6 diners, inclusively.

* * * * *